US007986872B2

(12) United States Patent
Steiner et al.

(10) Patent No.: US 7,986,872 B2
(45) Date of Patent: Jul. 26, 2011

(54) PROTECTIVE COVERING FOR HAND-HELD CAMERA

(76) Inventors: Dennis W. Steiner, Fort Collins, CO (US); Jan L. Avery, Fort Collins, CO (US)

( * ) Notice: Subject to any disclaimer, the term of this patent is extended or adjusted under 35 U.S.C. 154(b) by 690 days.

(21) Appl. No.: 11/619,147

(22) Filed: Jan. 2, 2007

(65) Prior Publication Data

US 2007/0175781 A1 Aug. 2, 2007

Related U.S. Application Data

(60) Provisional application No. 60/755,316, filed on Dec. 30, 2005.

(51) Int. Cl.
*B65D 85/38* (2006.01)

(52) U.S. Cl. ..... 396/27; 206/316.2; 150/154

(58) Field of Classification Search ..... 206/316.2, 206/16.1, 16.2, 3, 315.9, 5, 320; 383/41, 383/43, 71; 150/154; 396/27
See application file for complete search history.

(56) References Cited

U.S. PATENT DOCUMENTS

| | | | | | |
|---|---|---|---|---|---|
| 2,420,719 | A | * | 5/1947 | Park | 396/362 |
| 2,919,443 | A | * | 1/1960 | Kashiyama | 2/94 |
| 3,585,913 | A | | 6/1971 | Lange | |
| 4,136,726 | A | | 1/1979 | Lee | |
| 4,162,696 | A | * | 7/1979 | Sprung | 206/316.2 |
| 4,172,485 | A | | 10/1979 | Mathieu | |
| 4,176,701 | A | * | 12/1979 | Welgan | 206/316.2 |
| 4,232,808 | A | * | 11/1980 | Gray | 224/610 |
| 4,315,504 | A | * | 2/1982 | Drennan et al. | 128/892 |
| D272,541 | S | | 2/1984 | Schlagheck et al. | |
| 4,557,574 | A | | 12/1985 | Kohno et al. | |
| 4,572,633 | A | | 2/1986 | Burke | |
| 4,620,579 | A | | 11/1986 | Lowe et al. | |
| 4,646,973 | A | * | 3/1987 | Focaracci | 239/428.5 |
| 4,927,017 | A | | 5/1990 | Easter | |
| 4,953,695 | A | * | 9/1990 | Tallman | 206/5 |
| 4,982,841 | A | * | 1/1991 | Goedecke | 206/316.2 |
| 5,092,458 | A | | 3/1992 | Yokoyama | |
| D325,128 | S | | 4/1992 | Cyr et al. | |
| 5,172,838 | A | | 12/1992 | Rowell et al. | |
| 5,199,563 | A | | 4/1993 | Goodman | |
| 5,305,030 | A | | 4/1994 | Yokoyama et al. | |

(Continued)

FOREIGN PATENT DOCUMENTS

CA 2043938 C 6/1991

(Continued)

OTHER PUBLICATIONS

U.S. Appl. No. 60/755,316, filed Dec. 30, 2005.

(Continued)

*Primary Examiner* — J. Gregory Pickett
*Assistant Examiner* — Robert Poon
(74) *Attorney, Agent, or Firm* — Santangelo Law Offices, P.C.

(57) ABSTRACT

At least one embodiment of the inventive technology may be a removable protective covering for a camera, where the protective covering comprises a sleeve that has a first opening and a second opening. One or more of the openings may be defined by elastically deformable cuff(s) having unstretched and maximally stretched cross-sectional areas that are smaller and larger than certain cross-sectional areas of the camera. As such, the camera may be removable from the covering through such opening(s) as desired in order to shoot a photograph.

4 Claims, 9 Drawing Sheets

U.S. PATENT DOCUMENTS

| | | | | |
|---|---|---|---|---|
| 5,625,854 | A | 4/1997 | White | |
| 5,743,458 | A * | 4/1998 | French | 229/87.03 |
| 5,816,464 | A * | 10/1998 | Seiler | 224/615 |
| 5,882,295 | A | 3/1999 | Kope | |
| 5,907,721 | A * | 5/1999 | Schelling et al. | 396/27 |
| 5,956,527 | A | 9/1999 | Dowe | |
| 5,971,916 | A | 10/1999 | Koren | |
| 6,079,883 | A | 6/2000 | Mori | |
| 6,217,237 | B1 | 4/2001 | Ue et al. | |
| 6,278,846 | B1 | 8/2001 | Kobayashi et al. | |
| D459,879 | S | 7/2002 | Tyler | |
| D460,615 | S | 7/2002 | Hillman | |
| D460,773 | S | 7/2002 | Arbuckle | |
| 6,472,590 | B1 * | 10/2002 | Kulik | 84/453 |
| D465,328 | S | 11/2002 | Hassett | |
| D465,329 | S | 11/2002 | Hassett | |
| D467,074 | S | 12/2002 | Hillman | |
| D468,530 | S | 1/2003 | Murdoch et al. | |
| D473,051 | S | 4/2003 | Hassett | |
| 6,554,497 | B2 | 4/2003 | Kobayashi et al. | |
| D474,488 | S | 5/2003 | Arbuckle et al. | |
| 6,571,056 | B2 | 5/2003 | Shimaumura et al. | |
| D477,460 | S | 7/2003 | Hillman | |
| D477,710 | S | 7/2003 | Hillman | |
| D477,713 | S | 7/2003 | Murdoch et al. | |
| 6,637,952 | B2 | 10/2003 | Arbuckle et al. | |
| D482,526 | S | 11/2003 | Fair | |
| 6,647,555 | B2 * | 11/2003 | Yamaguchi et al. | 2/338 |
| D482,864 | S | 12/2003 | Hillman | |
| D490,772 | S | 6/2004 | Chu | |
| D491,357 | S | 6/2004 | Hassett | |
| D507,875 | S | 8/2005 | Hillman | |
| 6,941,066 | B2 | 9/2005 | Kawakami | |
| 7,293,648 | B2 * | 11/2007 | Doran, Jr. | 206/316.2 |
| 2001/0051045 | A1 | 12/2001 | Kobayashi et al. | |
| 2004/0135920 | A1 | 7/2004 | Choo | |
| 2004/0223754 | A1 | 11/2004 | Ma | |
| 2005/0019029 | A1 | 1/2005 | Kawakami | |

FOREIGN PATENT DOCUMENTS

| | | | |
|---|---|---|---|
| CA | 2065708 | C | 10/1992 |
| EP | 1494065 | A1 | 1/2005 |
| EP | 1494066 | A1 | 1/2005 |
| EP | 0933668 | B1 | 8/2005 |
| JP | 01288204 | | 11/1989 |
| JP | 2000023727 | A | 1/2000 |
| JP | 2000032315 | A | 1/2000 |
| JP | 2000225016 | A | 8/2000 |
| JP | 2001075157 | A | 3/2001 |
| JP | 2004170662 | A | 6/2004 |
| TW | 0420767 | B | 2/2001 |

OTHER PUBLICATIONS http://precision-camera.com/product/M9720GA (Ipod sock).
www.warehouseexpress.com; Index of Camera Accessories; Tenba RC-18 Rain Cover for camera with 300mm lens and hood.
www.warehouseexpress.com; CRC-11 XL2 Rain Cover.
www.warehouseexpress.com/photo/covers/covers.html; KATA Camera and Lens Cover; E 702 Elements Cover, E-704 Lens Sleeve Kit Optech Weatherguard waterproof cover; C60 Lens Hood Covers, C40 Lens Covers; C40.5 Camera Covers; Below Zero Camera Cover; Video Covers.
http://members.aol.com/torgophile/equip.html; Christian's camera gear.
http://www.lowepro.com/products/camera_pouches/designed_digital/; Lowepro Rezo 15; Lowepro Rezo 30; Lowepro D-Pods 40; Lowepro Stretch; Lowepro Camera Pouches; Designed for Digital.
http://amrys.devl.org/blog/archives/000391.html; Amshazam Aug. 2, 2004, I love the Apple Store.
http://www.shopping.com/xPR-Stylus_Verve_mini_Stylus_Verve_mini~RD-16795027268; It's Pretty But Is Just a Dumb Blonde?
www.shopping.com/xPO-Katadyn-Cameras-and-Photography; Cameras and Photography Rain & Snow Protection for Digital and Film SLR Cameras.
http://www.willotoons.com/2005/05/got-ipod-sock.php; WilloToons; Got an ipod sock?
www.warehouseexpress.com; KATA camera and Lens Cover.
www.warehouseexpress.com/photo/covers/covers.html; KATA RC-11 (CRC-11) Compact Rain Cover for Canon XL-1S, Optech Weatherguard waterproof cover, C40.5 Camera Covers; C40.5 Reversible double layer; Below Zero Camera Cover; Video Covers.
http://www.lowepro.com/products/camera_pouches/designed_digital/; Lowepro Rezo 15; Lowepro Rezo 30; Lowepro D-Pods 40; Lowepro Stretch; Lowepro Camera Pouches.
http://64.233.167.104; http://amrys.devl.org/blog/archives/000391.html; Amshazam Aug. 2, 2004, I love the Apple Store.
It's Pretty But Is Just a Dumb Blonde?; Shopping.com; http://66.102.7.104 (http://www.shopping.com/xPR-Stylus_Verve_mini_Stylus_Verve_mini~RD-16795027268.
www.shopping.com/xPO-Katadyn-Cameras-and-Photography.
Got an ipod sock?; WilloToons; http://www.willotoons.com/2005/05/got-ipod-sock.php.

* cited by examiner

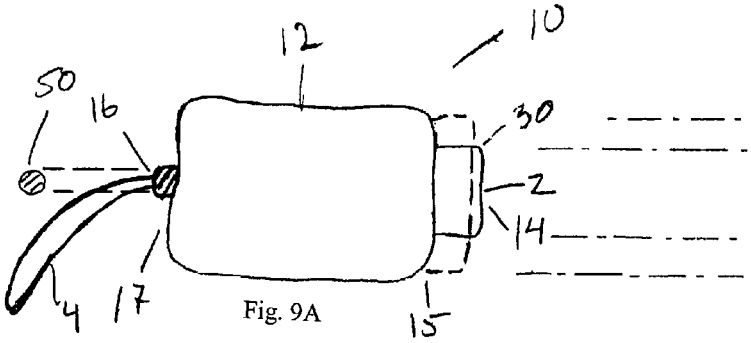
Fig. 9A
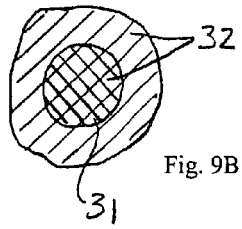
Fig. 9B
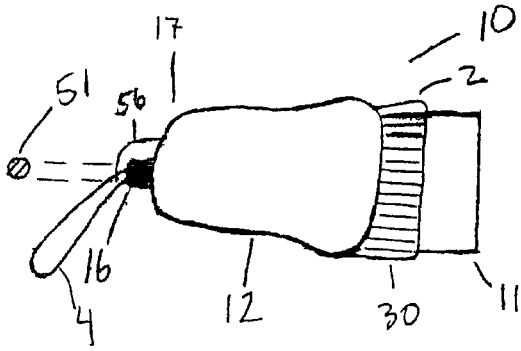
Fig. 9C
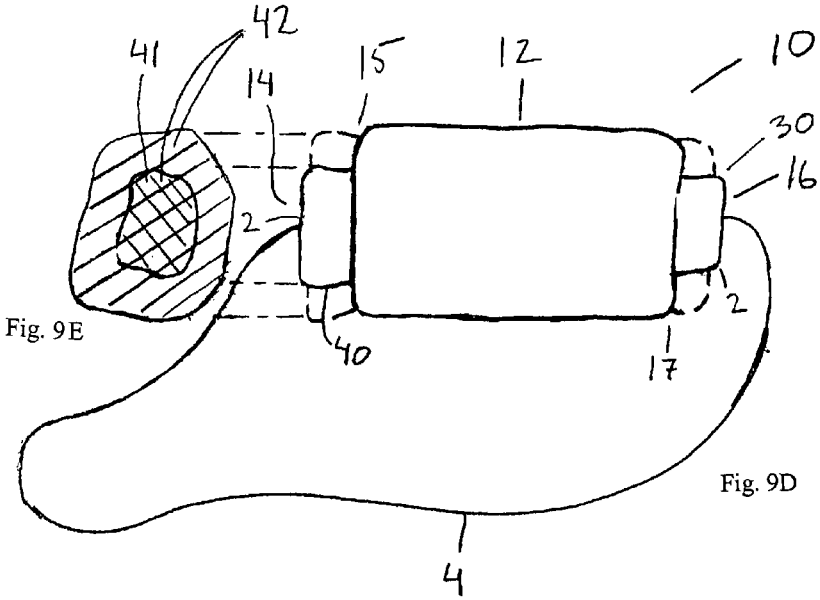
Fig. 9E
Fig. 9D

PROTECTIVE COVERING FOR HAND-HELD CAMERA

This United States Non-Provisional Patent Application claims priority to and the benefit of U.S. Provisional Application No. 60/755,316, filed Dec. 30, 2005, said provisional application hereby incorporated herein in its entirety.

BACKGROUND

Generally, this inventive technology relates to a protective covering for a piece of gear such as a camera. Specifically, at least one embodiment of this inventive technology focuses upon elastically deformable, soft, slidingly removable coverings for cameras. Although embodiments may focus on protective coverings for digital cameras, the inventive technology includes coverings for any type of camera, and indeed any type of delicate equipment that may be harmed, marred or scratched upon contact with other objects. Embodiments are particularly suited for protection of the camera during storage in a camera case (or, indeed, storage out in the open), or during retention by a user during "ready-to-shoot" non-use (e.g., retention strap attached to the camera and supported by a user's wrist or neck).

The desire to protect expensive, delicate equipment from physical injury has been known in some industries for some time. Anyone who has used delicate equipment such as a camera knows how easily they can be harmed or scratched. Cameras are, of course, often expensive pieces of equipment that, notwithstanding efforts to protect them, can be and often are harmed in some way (even if only slightly cosmetically marred). Even storage of a camera inside a case might not provide enough protection to the camera, as severe jostling of the case itself can cause enough relative movement between the case and a camera stored inside to harm the camera. Further, such cases often do not provide enough shock absorption protection to a camera stored within.

SUMMARY OF THE INVENTIVE TECHNOLOGY

The present invention includes a variety of aspects which may be selected in different combinations based upon the particular application or needs to be addressed. At least one embodiment of the inventive technology disclosed herein provides a covering that is snug enough to fit over a camera such that the camera, with the covering secured thereon, can be stored in a camera case or bag that is sized for the camera alone, and that protects the camera while encased—all without requiring a user purchase a new, larger sized camera case.

Embodiments enable this covering also to protect the camera while the camera is out of a storage case but not in use (e.g., when it is in "ready-to-shoot" mode, supported by strap (s) around a user's wrist or neck). Further advantages relate to facility and speed of storage within the protective covering, and removal therefrom—without compromising the protection afforded by the covering in its protection mode.

Such quick removal capability of preferred embodiments may be attributable to the provision of a sliding removal capability of the covering from around the camera; such embodiments might not require that a user manipulate any straps, remove one's eyes from an intended photographic subject, or otherwise do anything that would significantly slow down a camera retrieval, positioning, and/or photographic shoot. A quickly removable protective covering for a camera, as in at least one embodiment of the inventive technology, that operates to protect that camera without requiring that a case be used for protection (but one that is still usable with a case) can allow a user to retain a camera in a "ready-to-shoot" configuration while still protecting it against harmful contact.

Naturally, further objects of the invention are disclosed throughout other areas of the specification and claims.

BRIEF DESCRIPTION OF THE DRAWINGS

The following are figures or photos that show only examples of certain embodiments of the inventive technology and are not intended in any manner to limit the scope of any claims that may presented in this or related applications.

FIG. 9 shows several depictions, in outline, of different aspects of various embodiments of the inventive technology. FIG. 9A shows an embodiment particularly suited for cameras with a strap at only one end; FIG. 9B shows relevant cross-sectional areas of a cuff thereof; FIG. 9C shows an embodiment particularly suited for cameras with a strap at only one end while a camera is removed therefrom; FIG. 9D shows an embodiment particularly suited for cameras with a strap attached at each end of the camera; and FIG. 9E shows relevant cross-sections thereof.

FIG. 10 shows different views of cameras that the inventive technology may be used to protect.

DESCRIPTION OF THE PREFERRED EMBODIMENTS

Figure 1:
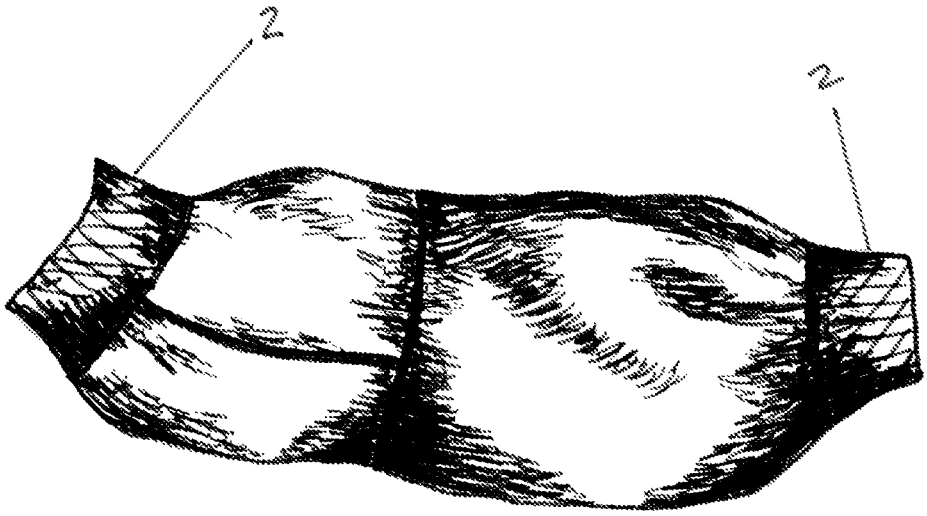
FIG. 1 shows an embodiment of the inventive technology particularly suited for cameras having a strap(s) at both ends of the camera.

As mentioned earlier, the present invention includes a variety of aspects, which may be combined in different ways. The following descriptions are provided to list elements and describe some of the embodiments of the present invention. These elements are listed with initial embodiments, however it should be understood that they may be combined in any manner and in any number to create additional embodiments. The variously described examples and preferred embodiments should not be construed to limit the present invention to only the explicitly described systems, techniques, and applications. Further, this description should be understood to support and encompass descriptions and claims of all the various embodiments, systems, techniques, methods, devices, and applications with any number of the disclosed elements, with each element alone, and also with any and all various permutations and combinations of all elements in this or any subsequent application.

Embodiments of the inventive technology may provide a protective covering having a length that is greater than the length of the camera it is to protect. Such enhanced length may improve retention of the covering in a protective configuration around the camera in that such "supplemental length" (the length of the covering less the length of the camera) may manifest as a section at one or both ends of the covering that has an unstretched cross-sectional area (e.g., having an unstretched cross-sectional diameter) that is less than the largest cross-sectional area of the camera, and/or a cross-sectional diameter of the camera at a proximal end (i.e., an end that is near that portion of the supplemental length). Such dimensioning may enhance retention of the covering onto the camera in that the stretching of this supplemental length (or portion thereof) that occurs when the camera is moved from a protective position within the covering may effect a force that counteracts such removal.

In preferred embodiments, this force is indeed surmountable by, e.g., the application of manual force (otherwise "sliding" removal of the camera from the covering would not be possible). Of course, the greater the resistance against removal as may be provided by the cross-sectional area, "strength" of elasticity and frictional resistance of the supplemental length (i.e., its "configuration"), the less likely unintentional removal of the camera from the protective covering will occur. "Strength" of elasticity may refer to the amount of force needed to deform the material so it stretches as intended (e.g., the amount of force needed to stretch a "cuff" so that a camera can pass through it). It should be noted that the portion of the covering that is not part of the "supplemental length" 1 (this portion may be referred to as the sleeve) may also be configured so as to prevent unintentional removal of the camera from the protective covering (or to assist in the prevention of such removal). However, as mentioned, in preferred embodiments, the force counteracting removal can be overcome by a reasonable manual force—a removal force—acting against it. Certainly, if the camera is to be removable at all from the covering by a sliding of the camera relative to the covering, a maximally stretched cross-sectional area of the "supplemental length" of the covering (e.g., one or more cuffs) is greater than the largest cross-sectional area of the camera.

The supplemental length (or at least a portion thereof) may be referred to as a cuff 2 when manifested at one or both terminal ends of the protective covering and when having a cross-sectional area in an unstretched configuration that is less than: (a) a maximum cross-sectional area of the camera, and/or a cross-sectional diameter of the camera at an end; and (b) the cross-sectional area of the body of the covering (the sleeve) in an undeformed configuration (e.g., when unstretched when it is stretchable). The presence of one or more cuffs is not a requisite feature of the inventive technology, but when a design does meet the above two criteria, a cuff is said to exist.

In at least one embodiment, when the camera is inside the covering (i.e., when the covering is in a protective configuration), the supplemental length (or a majority portion of it) may be in its unstretched configuration (simply because the camera might not be within it and thus not acting to stretch it). During removal of the camera from the protective covering, the camera may be slid through the supplemental length (e.g., cuff), which elastically deforms during such removal. After passage of the camera through the cuff, the cuff is in its undeformed configuration and therefore may act to prevent unintentional repositioning of the protective covering around the camera. Of course, the cuff may be any of a variety of areas (e.g., three inches in diameter, as but one of many examples).

Regardless of whether there is a cuff(s), the body of the protective covering (perhaps referred to herein as a sleeve, and denoting that portion of the covering other than the "supplemental length") may itself be elastically deformable. In at least one embodiment, indeed the sleeve is stretchable, and: (a) its undeformed area is less than a maximum area of the camera; and (b) its maximal elastically deformed area is greater than the maximum area of the camera. Such dimensioning may enable the sleeve to be snugly fit around the camera and/or retained thereto when protection of the camera is intended, thereby enhancing its retention thereon, and possibly enhancing its protective effect. An elastically deformable sleeve may also enable the use of the same protective covering with cameras of different size, and with a camera with different lens attachments.

Embodiments may include the benefit of securing (e.g., releasably) the protective covering onto the camera (including onto a wrist or neck strap that is attached to the camera), thereby abating risk of loss of the covering. Such securing may be provided by an unlockable lock closure 56 that secures the covering to the strap 4 (particularly the shorter, wrist strap (or indeed some of the neck straps) that do not connect to both ends of the camera). Closures might not be as helpful on those neck straps that connect with both sides of the camera because once such a strap(s) is run through the protective covering (likely by first temporarily disconnecting the strap(s) from one side of the camera), it is unlikely that a protective covering (particularly one that has two open ends) can be unintentionally disconnected from the camera and strap entirely.

Embodiments of the inventive technology may be particularly suited for use to protect certain types of cameras. Although a preferred application of the inventive technology may be protection of digital cameras, the inventive technology may also be usable to protect 35 mm cameras. Further, there are other delicate pieces of equipment that the inventive technology may be usable to protect, including, but not limited to cameras (including digital and traditional film cameras, whether SLR or otherwise, blackberries, PDA's, iPod's, portable digital music players, cell phones, etc.). The covering may be sized according to the piece of equipment the covering is intended to protect (e.g., so that the unstretched and maximally stretched cross-sectional areas enable passive retention of the covering on the camera, and removal of the covering from the camera, as desired.

Figure 2:
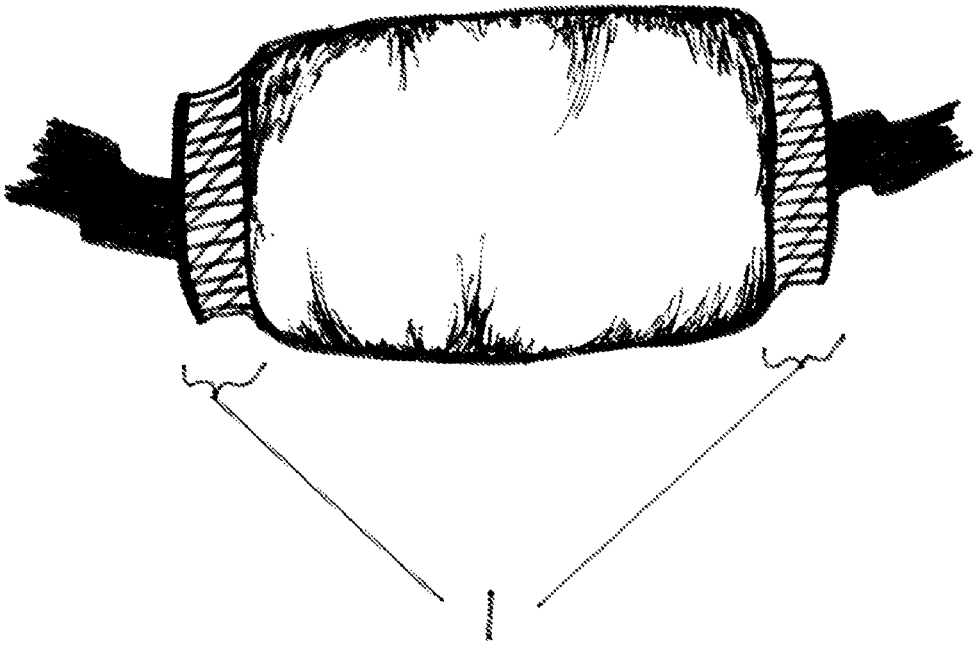
FIG. 2 shows another embodiment particularly suited for cameras having a strap(s) at both ends of the camera.
Figure 3:
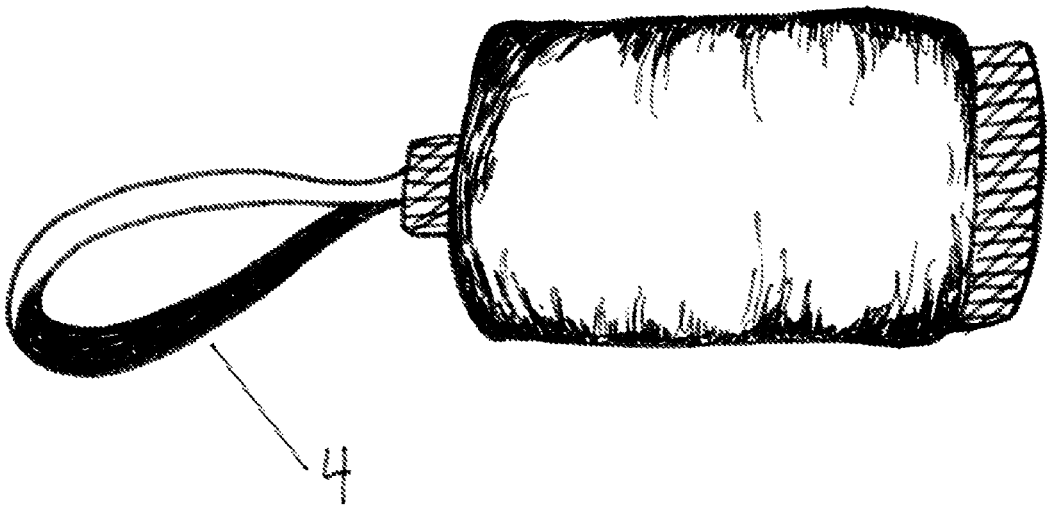
FIG. 3 shows an embodiment particularly suited for cameras having a strap(s) at one end of the camera.
Figure 4:
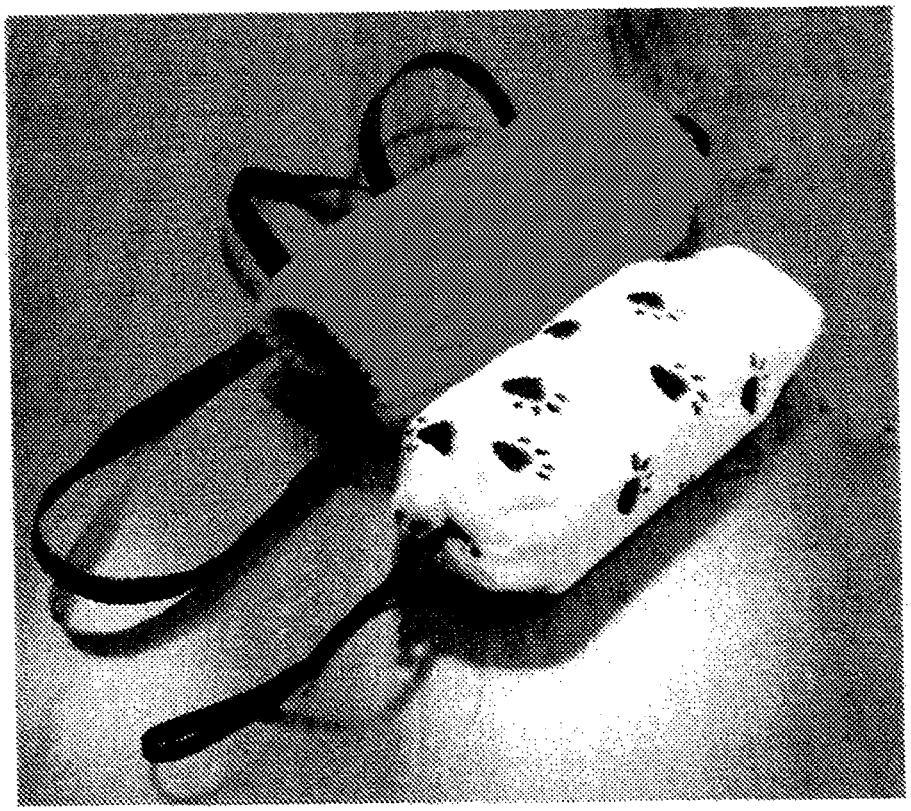
FIG. 4 shows two embodiments as each appears covering a camera.
Figure 5:
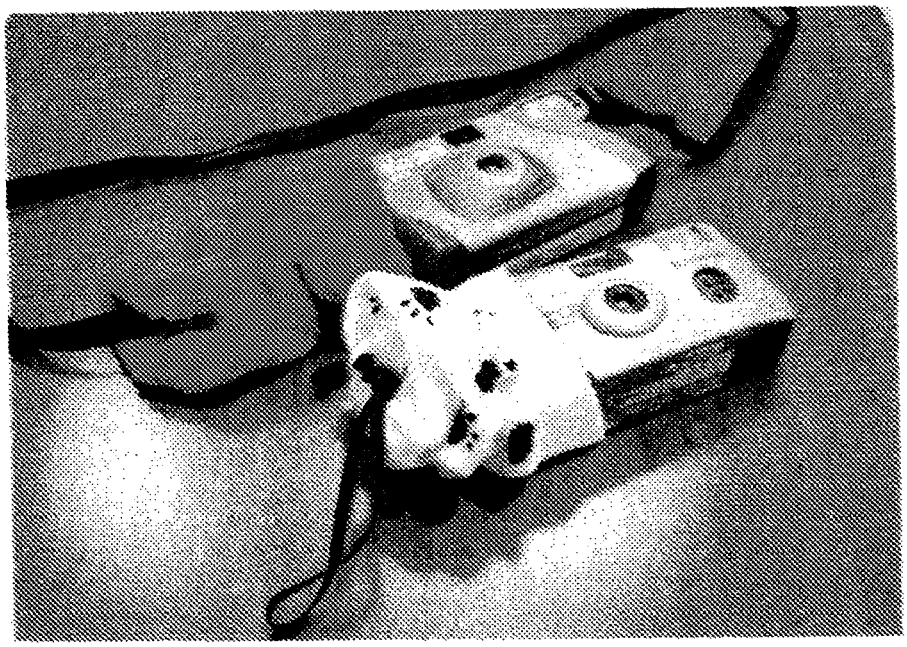
FIG. 5 shows two embodiments as each appears "scrunched" away from the camera.
Figure 6:
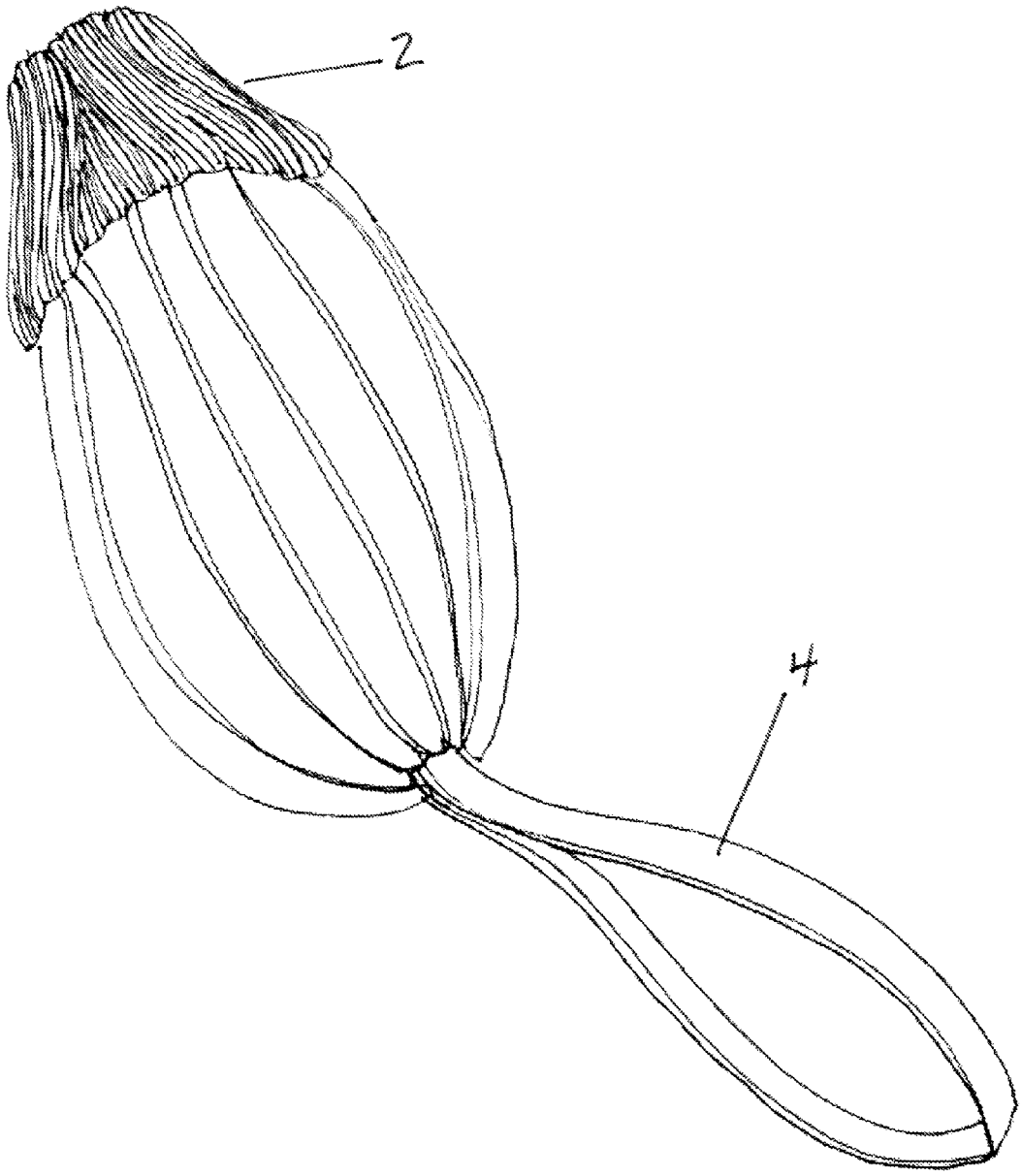
FIG. 6 shows an embodiment particularly suited for cameras having a strap(s) at one end of the camera.
Figure 7:
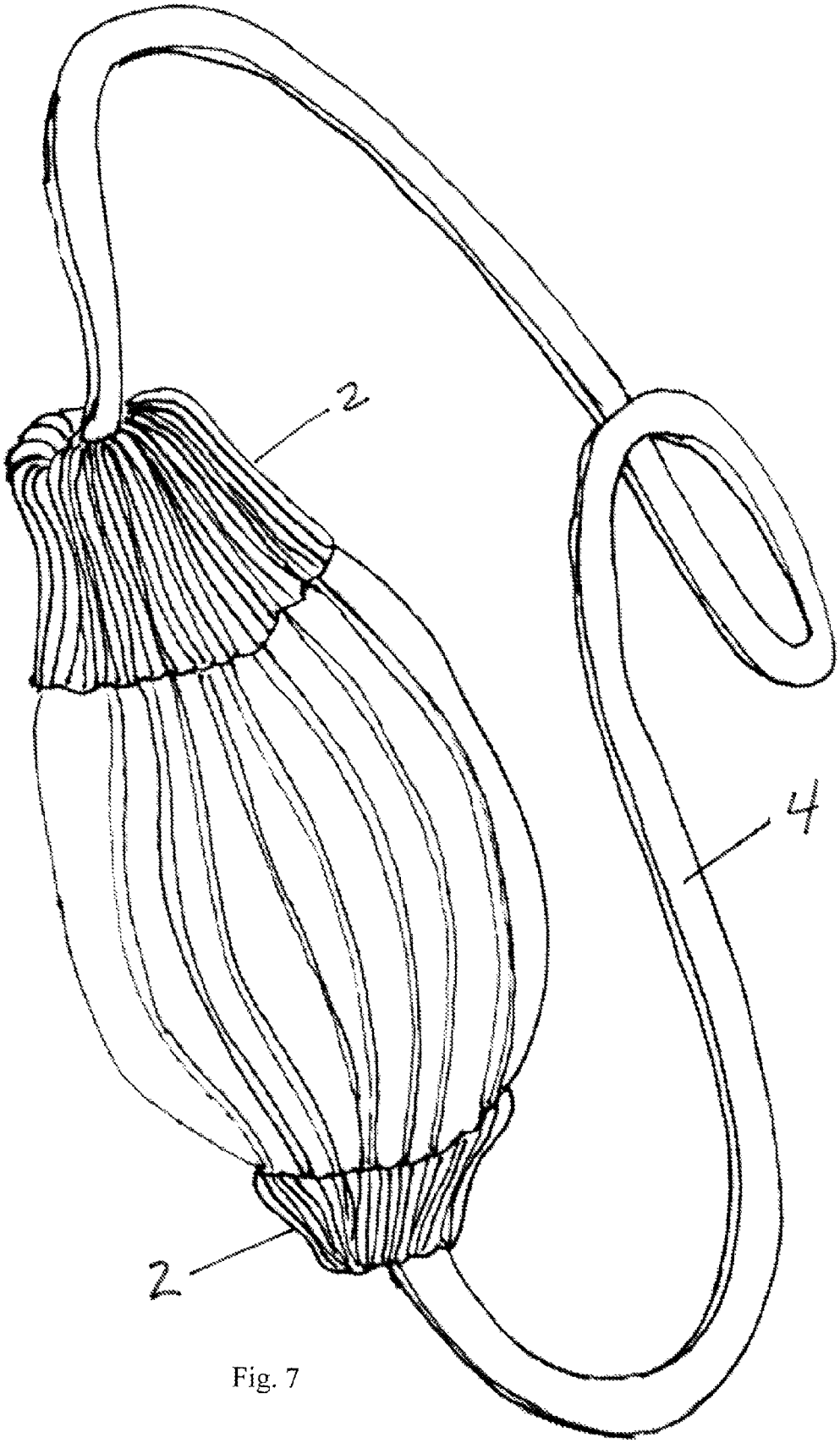
FIG. 7 shows an embodiment particularly suited for cameras having a strap(s) at both ends of the camera.
Figure 8:
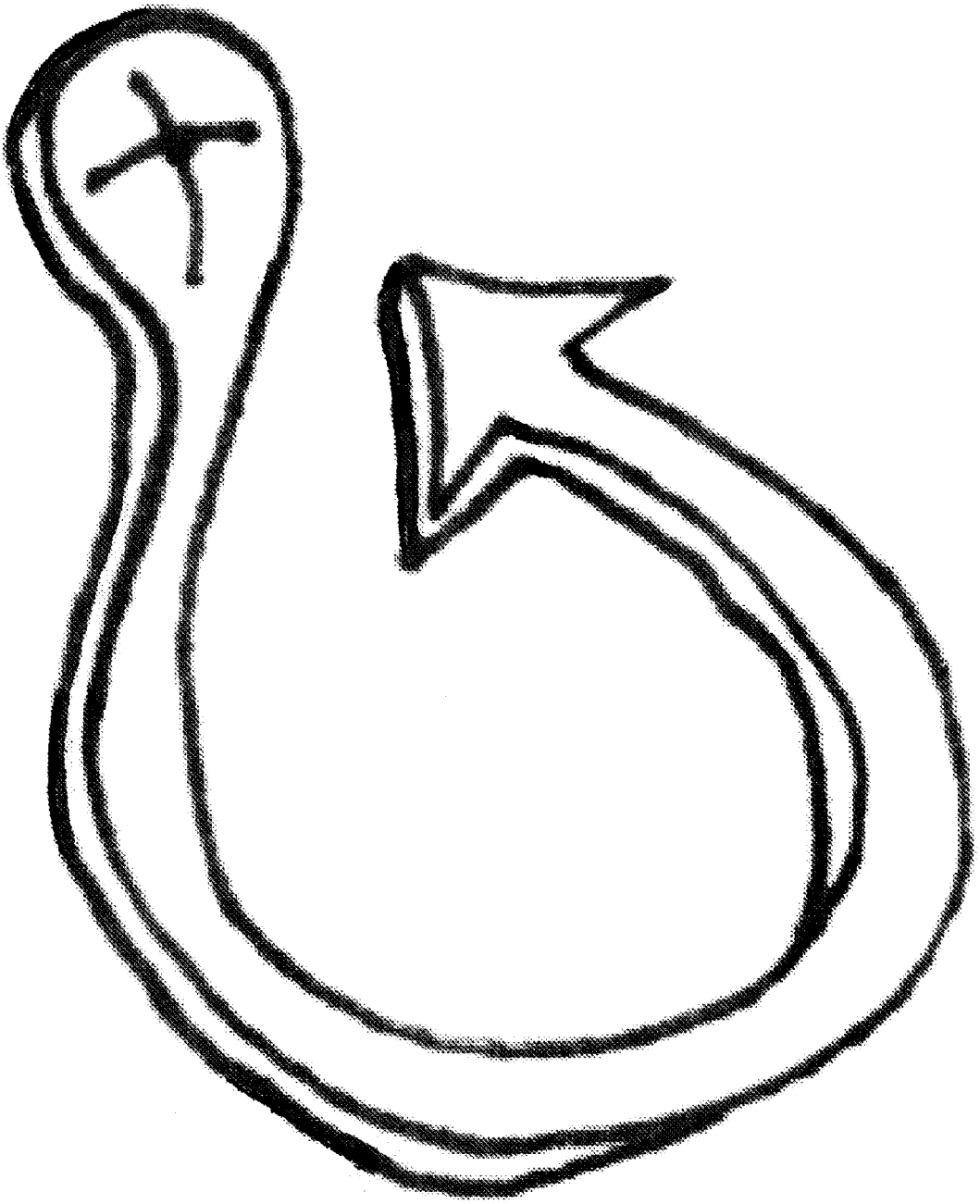
FIG. 8 shows an embodiment of a closure that may be useful to secure the covering to the strap.
Figure 10A:
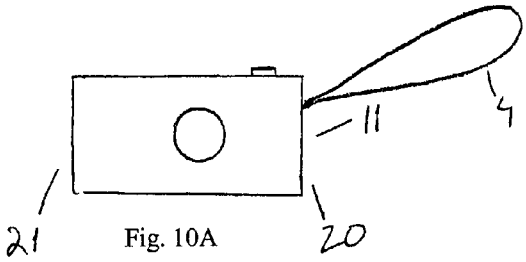
FIG. 10A shows a front view.
Figure 10B:
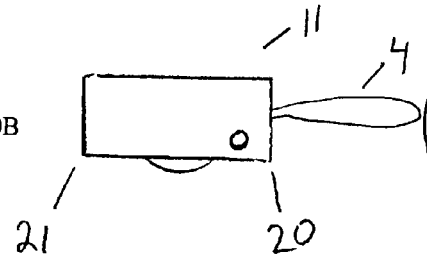
FIG. 10B shows a top view.
Figure 10C:
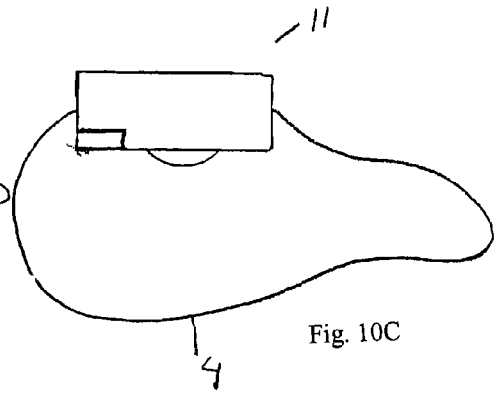
FIG. 10C shows a bottom view.
Figure 10D:
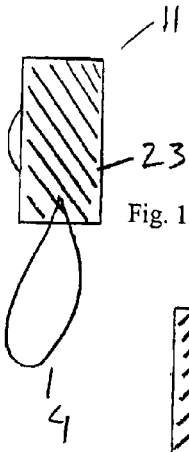
FIGS. 10D and 10E each show a side view.
Figure 10E:
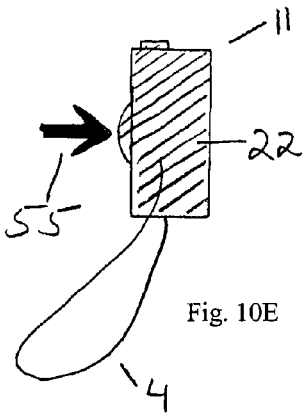
Figure 10F:
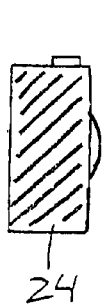
FIG. 10F shows a different side view.

When the inventive technology is intended to protect cameras, certain embodiments may be particularly suited for use with: a camera having a strap(s) attached at both ends (see, e.g., FIGS. 1 and 2); or a camera having a strap attached at only one end (see, e.g., FIG. 3). Those embodiments particularly suited for cameras having a strap(s) at only one end may, in at least one embodiment, have an end that is narrowed such that such end, when maximally deformed (whether it is stretchable or not), is greater than the maximum cross-sectional diameter of the camera, while another end of the covering may have an opening whose purpose is only to allow a camera strap to pass through (and not to allow passage of the camera therethrough). Such would allow removal of the camera from (and insertion of the camera into) the covering through only one end. The end of the covering having an opening whose purpose may be merely to allow the passage therethrough of a camera strap(s) may indeed be elastically deformable, but not have a maximum deformed area that is greater than any cross-sectional area of the camera (e.g., a height of the camera at that end). Of course, in at least some of the embodiments that are particularly suited for use with a camera having a strap attached at only one end, the ends of the covering may be different (e.g., their openings may be a different area and/or their maximum stretched areas may be different). Although such designs may be particularly suited for use with cameras having a strap(s) at one end, they may also find use to protect cameras having strap(s) at both ends.

Those embodiments particularly suited for cameras having a strap(s) at both ends of the camera may have two ends that are configured such that a maximum deformed (stretched) cross-sectional dimension (e.g., diameter) of the covering is greater than the maximum cross-sectional dimension of the camera (e.g., height), and such that a maximum unstretched cross-sectional dimension (e.g., diameter) of the covering is less than the maximum cross-sectional dimension of the camera (e.g., height). In some embodiments, such ends are cuffs. Such configuration may be achieved by appropriate sizing and selection of stretchable (elastically deformable) material. Indeed, the cuffs—and indeed any part of the covering—may be made from material may include stretchable cotton (including a cotton blend) as one might find in a crew sock. Embodiments particularly suited for cameras having a strap (s) at both ends of the camera, both ends of the covering may be identical (although they certainly need not be)

It should be noted that any end of the covering, whether elastic or not, and particularly where narrower relative to the sleeve of the covering, achieve such narrowed dimension by a "cinching" of that end. Such may be accomplished by provision in the material of a passage within the perimeter of that covering end, and placement in such passage of a cord, string or band that, whether elastic or not, is able to maintain the dimensions of that opening as necessary (e.g., undeformed opening diameter less than the camera height, and maximum stretched opening diameter either less than or greater than camera height, as required). Of course, where that "cinched" opening is intended to allow passage therethrough of the camera strap only (and not of the camera), the maximum diameter (whether the opening is stretchable or not) is to be less than the maximal cross-sectional dimension (e.g., height) of the camera itself (and perhaps less than the maximal cross-sectional dimension of the camera at that end). When the design intends to provide passage through the cinched opening of the camera, the maximal deformed (stretched) diameter of the opening should be greater than the maximal cross-sectional dimension (e.g., height) of the camera.

Indeed, appropriate selection of the material used for the covering may enhance the use of the covering, as an appropriately stretchable material (with an appropriately sized piece of material) will enable retention and removal of the covering as intended. In at least one embodiment, the selected material is a cushioning material. It may be made from fabric (including but not limited to washable and/or lightweight fabric); any stretchable sections thereof may include stretchable fabric (e.g., rubber or spandex), and/or may have a rib knit stitch. Indeed, in at least one embodiment having a cuff, the cuff exhibits ribbing with a rib knit stitch. It should be understood that elastically deformable (or stretchable) implies only the use of either stretchable fabric or a stitch (e.g., a rib stitch) that affords stretch capability. Proper material selection may allow for "scrunching" of the covering (or parts thereof) away from the body of the camera such that the length of the "scrunched" covering is significantly less than the covering while it is in protective mode covering the camera, and so that the covering does not interfere with the taking of photographs. Fabricating the embodiments of the inventive technology (once described to one of ordinary skill in the art), would be well within the skill of an ordinary artisan.

At least one embodiment of the inventive technology may be a removable protective covering 10 for a camera 11, where the protective covering comprises a sleeve 12 (which may be elastically deformable or not) that has a first opening 14 at a first end 15 of the sleeve 12 and a second opening 16 at a second end 17 of the sleeve 12. For purposes of clarity, the camera 11 is said to have two ends 20, 21, an overall largest cross-sectional area 22 and a largest cross-sectional area 23, 24 at each end of the camera when the covering is in a protective configuration around the camera (see, e.g., FIGS. 9A and 9D). The first opening 14 may be defined by a first elastically deformable cuff 30 that has an unstretched cross-sectional area 31 that is less than the largest cross-sectional area 23 of the camera at that end of the camera which is closest to first end of the sleeve when the covering is in a protective configuration around the camera. The first elastically deformable cuff 30 may have a maximally stretched cross-sectional area 32 that is greater than the overall largest cross-sectional area of the camera 22. It is of note that the cross-sectional areas of the camera referred to herein are in planes that are substantially parallel to (or coplanar with) that direction 55 characterizing light as it passes through the camera lens.

In particular embodiments (see, e.g., FIG. 9D), the second opening 16 may be defined by a second elastically deformable cuff 40 that has an unstretched cross-sectional area 41 that is less than a largest cross-sectional area 24 of the camera at that end of the camera which is closest to the second end of the sleeve when the covering is in protective configuration around the camera. The second elastically deformable cuff 40 may have a maximally stretched cross-sectional area 42 that is greater than the overall largest cross-sectional area 22 of the camera. In particular embodiments, the overall largest cross-sectional area 22 of the camera is equal to the largest cross-sectional area 24 of the camera at that end of the camera which is closest to the second end of the sleeve when the covering is in protective configuration around the camera.

In particular embodiments (see, e.g., FIG. 9C), the second opening 16 may have a maximal cross-sectional area 50 (whether it is elastically deformable or not) that is less than a largest cross-sectional area 24 of the camera at that end of the camera which is closest to the second end of the sleeve when the covering is in protective configuration around the camera. The second opening may have a minimal cross-sectional area 51 that is the same as its maximal cross-sectional area. It may merely be large enough to allow a strap to pass through it. Particular embodiments may include a closure 60 operable to secure the second opening in a second opening configuration which exhibits the minimal cross-sectional area.

As is clear from certain figures, in preferred embodiments, the removable protective covering for a camera does not comprise any straps. The curving dashed lines in FIGS. 9A and 9D outline maximally stretched cuffs.

In at least one embodiment, a camera protection method may comprise the steps of: establishing a camera in a sleeve of a removable protective covering for the camera; passively retaining for a first time the camera in the sleeve while supporting the camera from a strap of the camera; removing the camera from the sleeve by forcing the camera through an elastically deformable cuff; retaining the removable protective covering around a strap of the camera but not around the camera; shooting at least one photograph with the camera; re-establishing the camera in the sleeve of the removable protective covering by forcing the camera through the elastically deformable cuff; and passively retaining for a second time the camera in the sleeve while supporting the camera from the strap of the camera. The steps of passively retaining for a first time the camera in the sleeve and the step of passively retaining for a second time the camera in the sleeve each comprises the step of retaining the camera in the sleeve with the elastically deformable cuff. Indeed, such passive retention, in preferred embodiments, is effected, at least in part, by a cuff or cuffs of the covering. Where there is only one cuff, the remaining, non-cuffed opening may contribute to passive retention. Of course, as can be appreciated, passive retention refers to retention without, e.g., manual grasping or other involvement by, e.g., a photographer using the apparatus.

As can be easily understood from the foregoing, the basic concepts of the present invention may be embodied in a variety of ways. It involves both delicate equipment protection techniques as well as devices to accomplish the appropriate protection. In this application, the protection techniques are disclosed as part of the results shown to be achieved by the various devices described and as steps which are inherent to utilization. They are simply the natural result of utilizing the devices as intended and described. In addition, while some devices are disclosed, it should be understood that these not only accomplish certain methods but also can be varied in a number of ways. Importantly, as to all of the foregoing, all of these facets should be understood to be encompassed by this disclosure.

The discussion included in this provisional application is intended to serve as a basic description. The reader should be aware that the specific discussion may not explicitly describe all embodiments possible; many alternatives are implicit. It also may not fully explain the generic nature of the invention and may not explicitly show how each feature or element can actually be representative of a broader function or of a great variety of alternative or equivalent elements. Again, these are implicitly included in this disclosure. Where the invention is described in device-oriented terminology, each element of the device implicitly performs a function. Apparatus claims may not only be included for the device described, but also method or process claims may be included to address the functions the invention and each element performs. Neither the description nor the terminology is intended to limit the scope of the claims that will be included in any subsequent patent application.

It should also be understood that a variety of changes may be made without departing from the essence of the invention. Such changes are also implicitly included in the description. They still fall within the scope of this invention. A broad disclosure encompassing both the explicit embodiment(s) shown, the great variety of implicit alternative embodiments, and the broad methods or processes and the like are encompassed by this disclosure and may be relied upon when drafting the claims for any subsequent patent application. It should be understood that such language changes and broader or more detailed claiming may be accomplished at a later date (such as by any required deadline) or in the event the applicant subsequently seeks a patent filing based on this filing. With this understanding, the reader should be aware that this disclosure is to be understood to support any subsequently filed patent application that may seek examination of as broad a base of claims as deemed within the applicant's right and may be designed to yield a patent covering numerous aspects of the invention both independently and as an overall system.

Further, each of the various elements of the invention and claims may also be achieved in a variety of manners. Additionally, when used or implied, an element is to be understood as encompassing individual as well as plural structures that may or may not be physically connected. This disclosure should be understood to encompass each such variation, be it a variation of an embodiment of any apparatus embodiment, a method or process embodiment, or even merely a variation of any element of these. Particularly, it should be understood that as the disclosure relates to elements of the invention, the words for each element may be expressed by equivalent apparatus terms or method terms—even if only the function or result is the same. Such equivalent, broader, or even more generic terms should be considered to be encompassed in the description of each element or action. Such terms can be substituted where desired to make explicit the implicitly broad coverage to which this invention is entitled. As but one example, it should be understood that all actions may be expressed as a means for taking that action or as an element which causes that action. Similarly, each physical element disclosed should be understood to encompass a disclosure of the action which that physical element facilitates. Regarding this last aspect, as but one example, the disclosure of a "covering" should be understood to encompass disclosure of the act of "covering"—whether explicitly discussed or not—and, conversely, were there effectively disclosure of the act of "covering", such a disclosure should be understood to encompass disclosure of a "covering" and even a "means for covering" Such changes and alternative terms are to be understood to be explicitly included in the description.

Any acts of law, statutes, regulations, or rules mentioned in this application for patent; or patents, publications, or other references mentioned in this application for patent are hereby incorporated by reference. In addition, as to each term used it should be understood that unless its utilization in this application is inconsistent with a broadly supporting interpretation, common dictionary definitions should be understood as incorporated for each term and all definitions, alternative terms, and synonyms such as contained in the Random House Webster's Unabridged Dictionary, second edition are hereby incorporated by reference. Finally, all references listed in the list of References To Be Incorporated By Reference In Accordance With The Provisional Patent Application or other information statement filed with the application are hereby appended and hereby incorporated by reference, however, as to each of the above, to the extent that such information or statements incorporated by reference might be considered inconsistent with the patenting of this/these invention(s) such statements are expressly not to be considered as made by the applicant(s).

Thus, the applicant(s) should be understood to have support to claim and make a statement of invention to at least: i) each of the camera protection devices as herein disclosed and described, ii) the related methods disclosed and described, iii) similar, equivalent, and even implicit variations of each of these devices and methods, iv) those alternative designs which accomplish each of the functions shown as are disclosed and described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) each system, method, and element shown or described as now applied to any specific field or devices mentioned, x) methods and apparatuses substantially as described hereinbefore and with reference to any of the accompanying examples, xi) the various combinations and permutations of each of the elements disclosed, and xii) each potentially dependent claim or concept as a dependency on each and every one of the independent claims or concepts presented.

With regard to claims whether now or later presented for examination, it should be understood that for practical reasons and so as to avoid great expansion of the examination burden, the applicant may at any time present only initial claims or perhaps only initial claims with only initial dependencies. Support should be understood to exist to the degree required under new matter laws—including but not limited to European Patent Convention Article 123(2) and United States Patent Law 35 USC 132 or other such laws—to permit the addition of any of the various dependencies or other elements presented under one independent claim or concept as dependencies or elements under any other independent claim or concept. In drafting any claims at any time whether in this application or in any subsequent application, it should also be understood that the applicant has intended to capture as full and broad a scope of coverage as legally available. To the extent that insubstantial substitutes are made, to the extent that the applicant did not in fact draft any claim so as to literally encompass any particular embodiment, and to the extent otherwise applicable, the applicant should not be understood to have in any way intended to or actually relinquished such coverage as the applicant simply may not have been able to anticipate all eventualities; one skilled in the art, should not be reasonably expected to have drafted a claim that would have literally encompassed such alternative embodiments.

Further, if or when used, the use of the transitional phrase "comprising" is used to maintain the "open-end" claims herein, according to traditional claim interpretation. Thus, unless the context requires otherwise, it should be understood that the term "comprise" or variations such as "comprises" or "comprising", are intended to imply the inclusion of a stated element or step or group of elements or steps but not the exclusion of any other element or step or group of elements or steps. Such terms should be interpreted in their most expansive form so as to afford the applicant the broadest coverage legally permissible.

Finally, any claims set forth at any time are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

What is claimed is:

1. A camera protection method comprising the steps of:

establishing a handheld digital camera entirely within a removable protective covering for said camera, said camera having an overall largest cross-sectional size, said covering having a center portion that has a center portion inner diameter, and said cover having only two openings, one of which is a first opening defined by an elastically deformable cuff that is sized to allow passage therethrough of said camera, and the other of which is a second opening, wherein said elastically deformable cuff has:

an unstretched cross-sectional size that is smaller than said overall largest cross-sectional size of said camera, a maximally stretched cross-sectional size that is larger than said overall largest cross-sectional size of said camera, and a cuff inner diameter when said cuff is elastically undeformed, wherein said cuff inner diameter is less than said center portion inner diameter, wherein said camera has two ends, an end to end camera length, and a length axis defined by said end to end camera length, wherein, when said covering is established around said camera, said covering has an end to end covering length, said end to end covering length greater than said end to end camera length, wherein said second opening of said only two openings is smaller than said first opening and does not allow passage therethrough of either end of said camera;

passively retaining said camera in said covering for a first time while said covering is in a protective configuration around all of said camera, while supporting said camera from a strap of said camera, and while said strap passes through said second opening but not through said first opening, wherein said strap has two ends, one of which is a camera proximal end that is attached to said camera, wherein during said step of passively retaining said camera in said covering for said first time:

at least a portion of said elastically deformable cuff is elastically undeformed, not around said camera and not around said strap of said camera, and said elastically deformable cuff exerts a retention force against said camera that retains said all of said camera entirely in said covering against said second opening, removing said camera from said covering by forceably, slidably moving said all of said camera along said length axis and through said elastically deformable cuff of said covering while said strap of said camera is through said second opening only and around a neck or wrist of a photographer performing said step of removing said camera;

manually counteracting said retention force while performing said step of removing said camera from said covering;

retaining, when said camera is outside of said covering, said covering:

around said camera proximal end of said strap of said camera, in contact with said camera, and immediately adjacent said camera;

shooting a photograph with said camera while performing said step of retaining said covering around said camera proximal end of said strap of said camera, and while said covering is in contact with said camera and immediately adjacent said camera;

wherein, during said step of shooting a photograph with said camera while performing said step of retaining said covering around said strap of said camera, said covering has a deformed length, and said deformed length is less than said length of said covering between said two openings when said covering is established around said camera, re-establishing said all of said camera in said covering by sliding said all of said camera back through said elastically deformable cuff;

elastically deforming said elastically deformable cuff while performing said step of re-establishing said camera in said covering; and passively retaining said camera in said covering for a second time while supporting said camera from said strap of said camera, said strap passing through said second opening only, wherein, during performance of said step of removing said camera from said, covering both hands of a photographer performing said step of removing said camera are outside of said covering.

2. A camera protection method as described in claim 1 wherein said step of shooting a photograph with said camera is performed by said photographer while said photographer has both hands and forearms outside of said covering.

3. A camera protection method as described in claim 1 further comprising the step of cinching said second opening.

4. A camera protection method as described in claim 3 wherein said step of cinching said second opening comprises the step of cinching said second opening around said strap of said camera.

* * * * *